United States Patent [19]

Opsvik

[11] Patent Number: 4,890,886

[45] Date of Patent: Jan. 2, 1990

[54] TILTING MECHANISM, PREFERABLY FOR A CHAIR SEAT OR SIMILAR ARTICLE

[75] Inventor: Peter Opsvik, Asker, Norway

[73] Assignee: Peter Opsvik A/S, Asker, Norway

[21] Appl. No.: 235,900

[22] PCT Filed: Jan. 31, 1988

[86] PCT No.: PCT/NO88/00004

§ 371 Date: Aug. 16, 1988

§ 102(e) Date: Aug. 16, 1988

[87] PCT Pub. No.: WO88/05276

PCT Pub. Date: Jul. 28, 1988

[30] Foreign Application Priority Data

Jan. 23, 1987 [NO] Norway ..... 870301

[51] Int. Cl.[4] ..... A47C 1/02

[52] U.S. Cl. ..... 297/313; 248/596; 248/632; 297/302

[58] Field of Search ..... 297/303, 302, 301, 261, 297/264, 313; 248/566, 569, 570, 632, 633, 593, 594, 596, 605

[56] References Cited

U.S. PATENT DOCUMENTS 2,184,988 12/1939 Collier et al. ..... 248/596 X 3,770,235 11/1973 Klapporth et al. ..... 248/632 X

FOREIGN PATENT DOCUMENTS 33758 8/1928 France ..... 248/594

*Primary Examiner*—James T. McCall

*Attorney, Agent, or Firm*—Darby & Darby

[57] ABSTRACT

A tilting mechanism (1), preferably for a chair seat or similar article, comprises a rigid element (2) which, via a mounting means (3), can be attached to a chair base (4), a supporting means (6) adapted to the chair seat and pivotably connected in relation to said mounting means (3), resilient means (8*a*, 8*b*) so arranged between the supporting means (6) and the rigid plate (2) that the supporting means (6) can be tilted in relation to said rigid plate (2) under the influence of the resilient means (8*a*, 8*b*), as well as locking means (20, 21, 24) for adjusting the seat supporting means (6) to various tilting positions. To achieve a compact tilting mechanism offering separate or individual tightening of the tilting stiffness in the forward direction and the rearward direction without changing the seat angle in relation to the neutral it is, suggested that at least one of the resilient means (8*a*, 8*b*) be displaced in relation to the tilting shaft (5) of the supporting means (6). Appropriately, there may be provided a first resiliant means (8*a*) co-operating with a first portion of the rigid element (2), as well as a resilient means (8*b*) which co-operates with a second portion of the rigid element (2), each of the resilient means (8*a*, 8*b*) being displaceable independent of each other in relation to the tilting shaft (5) of the supporting means (6) by means of displacing means, preferably its own lever (10*a*, 10*b*).

36 Claims, 4 Drawing Sheets

TILTING MECHANISM, PREFERABLY FOR A CHAIR SEAT OR SIMILAR ARTICLE

The present invention relates to a tilting mechanism, preferably for a chair seat or similar article, comprising a rigid element which via a mounting means can be attached to a chair base, a supporting means adapted to the chair seat and pivotably connected in relation to said mounting means, resilient means so arranged between said supporting means and said rigid element that said supporting means can be tilted in relation to said rigid element under the influence of said resilient means, as well as locking means for adjusting said seat supporting means to various tilting positions.

From German Offenlegungsschrift No. 2.022.525 there is known a tilting means, wherein an elastic body is arranged on each side of a tilting shaft, each of said bodies dampening the tilting movement of an upper movable plate, which for example can carry a chair seat, in relation to a stationary rigid plate. It is true that in said Offenlegungsschrift it is suggested that one of the elastic bodies can have a different distance from the tilting shaft in relation to the second elastic body, but in said patent publications no hints are given of how such a distance can be adjustable, let alone continuously adjustable for said pair of elastic bodies for thereby providing a simple and expedient adjustment of the dampening of the tilting movement. The prior art elastic bodies are arbitrarily arranged between said two plates and are held in position by means of friction between their upper surfaces and the opposite surfaces of said plates. The solution according to the German patent publication is space requireing, and no locking function is achieved in the various tilting positions.

From GB patent publication No. 1.324.451 there is known a tilting mechanism for a chair, comprising a fixed plate and a tilting plate, said two plates being interconnected by means of a resilient hinge comprising a pair of resilient means which co-operate with the upper side and the lower side of the fixed plate, respectively.

Besides, the tilting movement is controlled by a pretightening means which can be adjusted in relation to how soft or how stiff the tilting movement should be. However, this patent publication does not give any instructions for any resilient means which can be displaced for the purpose of adjusting the resistance against the tilting movement, let alone instructions for making these resilient means individually displaceable or adjustable.

Further, from Norwegian patent application No. 84.1843 there is known a tilting mechanism of the type as stated in the preamble, wherein a the front of and at a distance from the pivoting shaft of the tilting mechanism there are provided elastic resilient means, one of said means being provided on the upper side of the rigid plate, whereas the second means is provided on the lower side of the rigid plate, said means being arranged co-axially and being attached to the rigid plate by means of a threaded bolt which fixes the position of the resilient means in relation to said pivoting shaft.

In connection with the tilting arrangement according to Norwegian patent application No. 84.1843 the degree of compensation and thereby the stiffness of the tilting of the seat is effected by means of an adjustment device provided at the lower end of said threaded bolt, an adjutment which entails that the seat angle is changed by the adjustment, for example by having the forward portion of the seat pulled downwardly uppon tightening of said adjustment device. Thus, the prior art adjustment device does not give any instructions for how to achieve different tilting stiffness for tilting forwardly and tilting rearwardly, and then without screwing and without the risk of having the original seat angle changed during the adjustment.

Accordingly, the present invention has for an object to provide a tilting mechanism of the type stated in the preamble, which has a compact design, and which also renders an individual adjustment of the tilting stiffness in the forward or rearward direction, and at the same time avoiding any screwing movement during the adjustment, which usually has to be effected underneath the seat.

According to the present invention this is achieved in that at least one of the resilient means can be displaced in relation to the tilting shaft of said supporting means, for thereby regulating the force which influences the resilient means, and thereby the resilient movement to which the supporting means is subjected during tilting.

For example there may be provided a resilient means which co-operates with the upper side of a rigid plate, and a resilient means which co-operates with the lower side of said rigid plate, each of the resilient means being displaceable independently of each other in relation to the tilting shaft of said supporting means.

Alternatively, there may be provided a first resilient means which co-operates with for example the upper side of a rigid plate and on the forward side of the tilting shaft, and a second resilient means which also co-operates with the upper side of the rigid plate, but on the rear side of said tilting shaft.

Of course both resilient means may co-operate with the lower side of said plate.

In an alternative embodiment the rigid element may take the form of a sleeve which is threaded on to the chair base, so as to provide substantially vertically extending surfaces, with which the resilient means can come in contact and cooperate.

In other words, according to the invention each of the resilient means may be displaced towards or from the tilting shaft, a longer arm entailing a stiffer tilting movement, whereas a shorter arm entails a softer tilting movement.

Appropriately, each of the resilient means may be provided in a common housing supporting means, one of the resilient means being attached to a pivotable lever which is pivotably attached to a first portion of said housing, whereas the second resilient means is attached to a second pivotable lever which in turn is pivotably arranged on a second portion of said housing.

Each of the levers can than be provided with an end portion protruding freely through a slit in a housing wall, each of said resilient means upon pivoting said levers being swept along its individual surface of the rigid element for adjusting the tilting stiffness in the forward and the rearward direction, respectively.

Thus, by means of said levers each of the resilient means can be displaced from a rearward position close to the tilting shaft of the seat supporting means, and to a forward position at a marked distance from said tilting shaft. This, in it self, means that the user, when both elastic resilient means are in their rearward position, can easily effect a tilting movement in both directions, i.e. forwardly and rearwardly, whereas the user, when both means are in their forward position, will meet large tilting resistance. Thus, the user can by adjusting the displaceable means to various intermediate positions, be able to choose an appropriate degree of tilting resistance in the forward direction or rearward direction.

In order to achieve the various slanted positions of the seat there is provided a first engagement means at the end of the rigid plate, whereas in the housing-shaped supporting means there is provided a corresponding engagement means which can be brought into and out of engagement with said first engagement means, for locking the housing-shaped supporting means in various tilting positions.

In the following the invention will be further disclosed, reference being had to the Figures of the drawings illustrating a preferred embodiment for a tilting mechanism according to the present invention.

Figure 1:
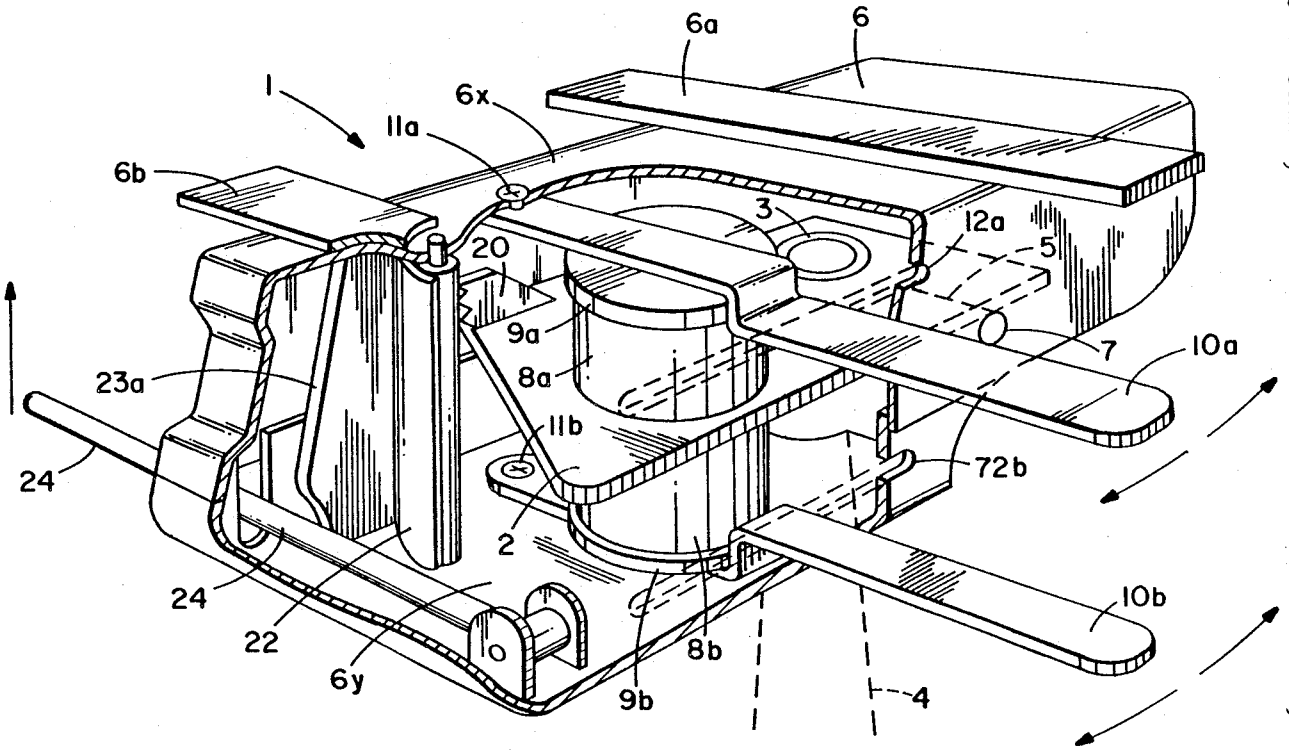
FIG. 1 is a schematic perspective view partly broken away, of an embodiment of the present tilting mechanism, as seen from one side.

In the attached FIGS. 1–5 there is illustrated a first example of a tilting mechanism according to the present invention, said tilting mechanism generally being designated by reference numeral 1. The tilting mechanism is contemplated used for a chair seat or similar article and comprises a rigid element in the form of a plate 2, which in turn comprises a mounting means 3 in the form of a conical pipe piece. The mounting means 3 can be brought into engagement with a base of for example an office chair, which here has been depicted by dashed lines and reference numeral 4. When the plate 2 including its mounting means 3 is mounted on the chair base 4, the plate 2 and the attachment means 3 will be stationary in relation to the chair base 4.

In the area of the mounting means 3 there is provided a pivoting shaft 5, a housing-shaped supporting means 6 being pivotably mounted on said shaft 5, and said shaft 5 protruding out from both sides of the mounting means 3 and being provided with an end bearing 7. Possibly, the shaft 5 can be attached to the supporting means 6 and be pivotably mounted in the mounting means 3.

In other words the supporting means 6 can pivot in relation to the rigid plate 2 and mounting means 3, i.e. in relation to the chair base 4. The supporting means 6 is provided with two upper mounting elements 6*a* and 6*b* representing attachment means for a not illustrated chair seat. Thus, a chair seat mounted on the supporting means 6 would be able to pivot in relation to said rigid plate 2 and, besides, in relation to the chair base 4.

Figure 2:
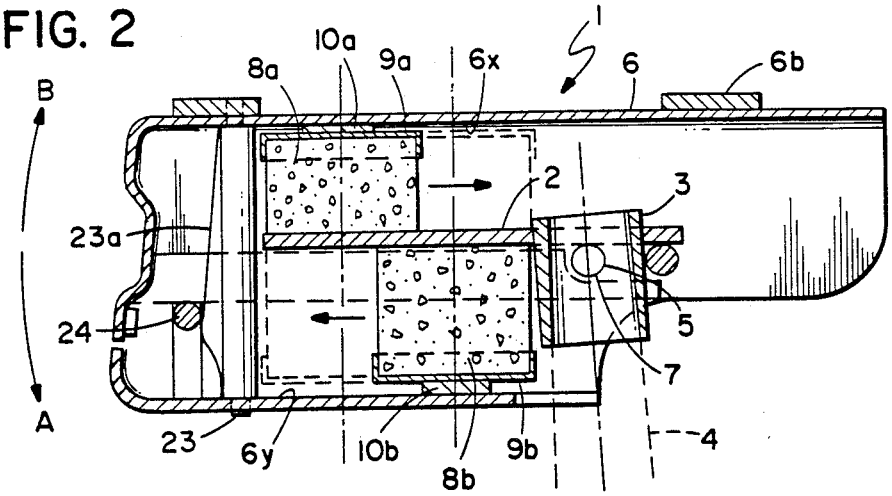
FIG. 2 is a schematic section through the embodiment illustrated in FIG. 1, the resilient means being displaced in each direction.

In FIG. 2 there is by means of the arrows A and B illustrated that the supporting means 6 can be tilted upwardly or downwardly, said arrows being illustrated at the forward end of the tilting mechanism, such that pivoting in the direction of the arrow A involves a forward tilting of the chair seat, whereas pivoting in the direction of the arrow B involves a rearward tilting of the chair seat.

In order to ensure that the chair seat can be tilted controllably both forwardly and rearwardly, there is in the supporting means 6 between appropriate portions of the supporting means 6 and the rigid plate 2, provided resilient means adapted so as to individually influencing the tilting stiffness of the supporting means 6, both in the forward direction and the rearward direction of the not illustrated seat provided on the supporting means 6.

In the illustrated embodiment the resilient means comprise an upper resiliant means 8*a* and a lower resilient 8*b*, the upper resilient means 8*a* being provided between the top portion 6*x* of the supporting means 6 and the rigid plate 2, whereas the lower resilient means 8*b* being provided between the bottom portion 6*y* of the supporting means 6 and said rigid plate 2.

Further, the upper resilient means 8*a*, which here is illustrated as a cylindrical, elastic rubber block, attached in a lid-shaped holding means 9*a* which in turn is attached in an upper lever 10*a*. The lever 10*a* is in turn pivotably mounted in the top portion 6*x* of the supporting means 6, for example by means of a pivot pin 11*a*.

Correspondingly, the lower elastic means 8*a* is attached in a cup-shaped holding means 9*b* which in turn is attached to a lower lever 11*b* which is pivotably provided in the bottom portion 6*y* of the supporting means 6, by means of a pivoting means 11*b*.

Each of the levers 10*a* and 10*b* has a free end portion extending through its own substantially transverse slot 12*a* and 12*b*, respectively, such that the user of the chair by means of the levers 10*a* and 10*b* can pivot each of the resilient means 8*a* and 8*b* individually along the upper side and the lower side, respectively, of the rigid plate 2 for adjusting the seat tilting stiffness.

Thus, by means of the levers 10*a* and 10*b* each of the elastic means 8*a*, 8*b* can be displaced individually between a rearward position close to the tilting shaft 5 of the seat supporting means 6, and a forward position at a marked distance from said tilting shaft 5.

As appearing from FIG. 2 the upper resilient means 8*a* is here displaced to its furthermost front position by means of the lever 10*a*, which entails the achievement of a larger tilting stiffness when the seat is to be tilted forwardly, i.e. in the direction of the arrow A.

On the other side the lower resilient means 8*b* has been displaced to its extreme rear position close to the mounting means 3 by the lever 10*b*, in which position of the elastic means 8*b* the seat will render small tilting stiffness in the rearward tilting direction, i.e. in the direction of the arrow B. Such a position of the resilient means 8*a*, 8*b* can for example be suitable for users of heavy weight, who most often use the chair in a rearwardly tilted position.

The opposite picture would the case if a person of light weight is involved, having a desire for an easier adjustment of the seat in a forwardly tilted position. The displaceable elastic means 8*a*, 8*b* would then take the positions which are opposite of those illustrated in FIG. 2.

Figure 3:
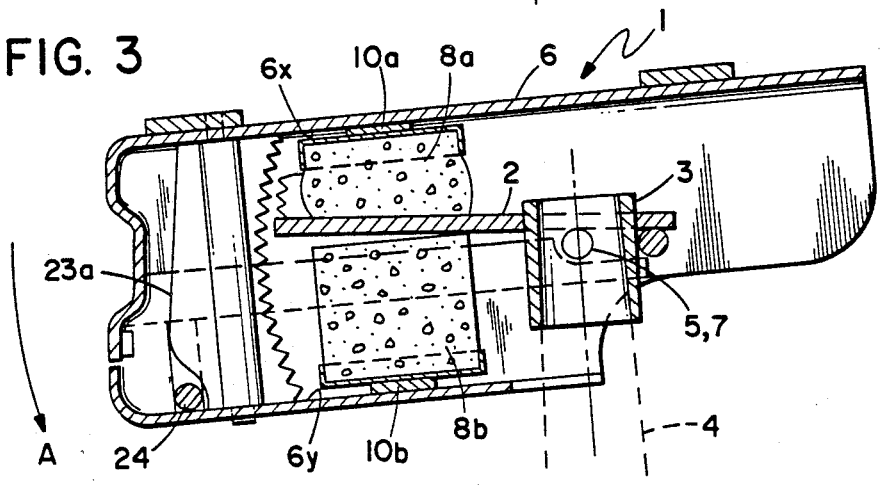
FIG. 3 is a section similar to FIG. 2, and illustrates the tilting mechanism in a forwardly tilted position.
Figure 5:
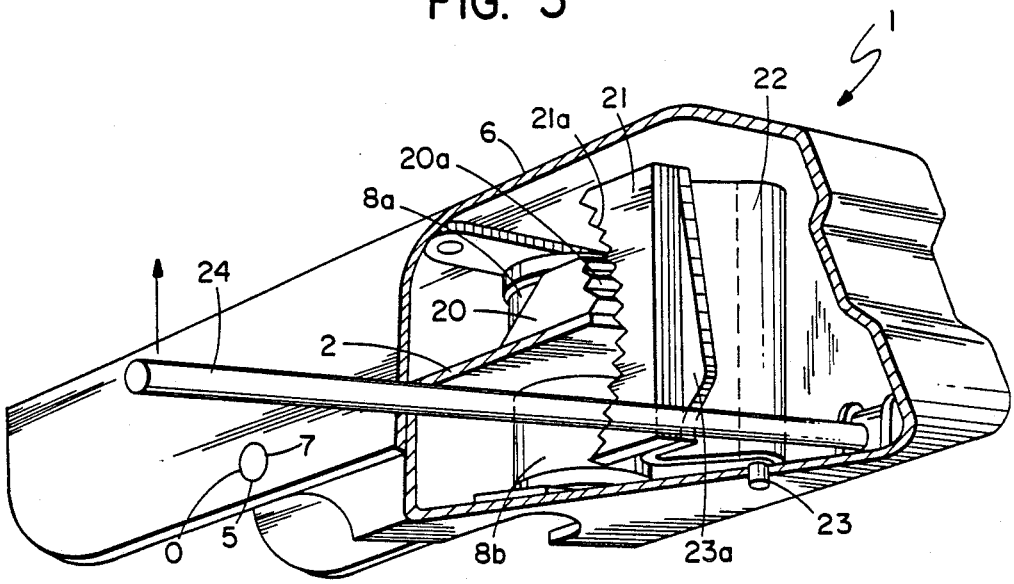
FIG. 5 is a perspective view similar to FIG. 1, as seen from the other side.
Figure 6:
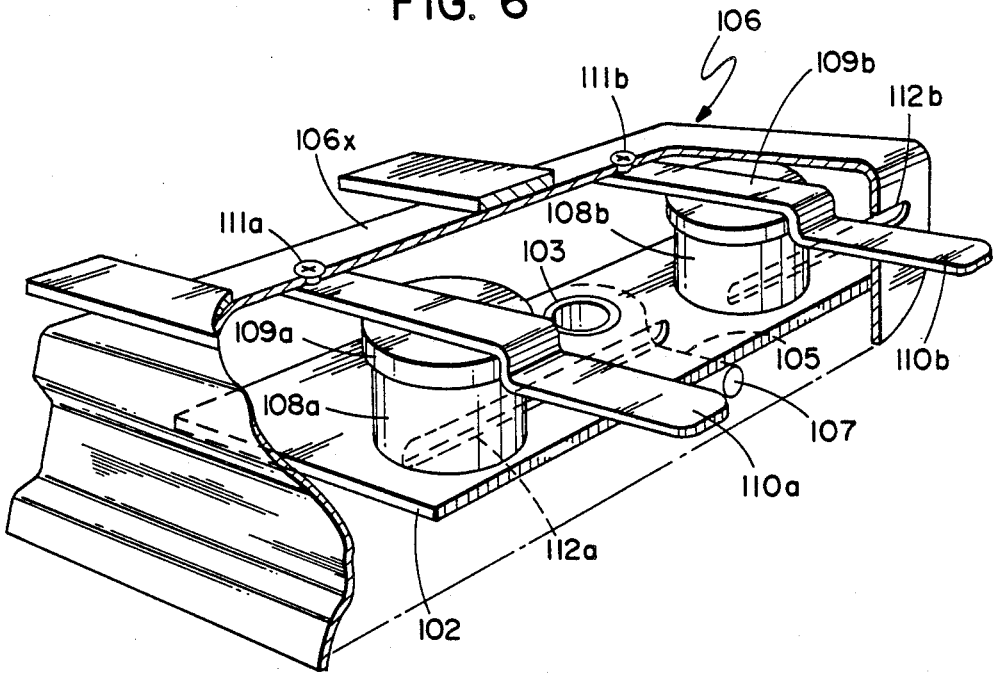
FIG. 6 is a schematic perspective view partly broken away of another embodiment of the present tilting mechanism, as seen from one side.
Figure 7:
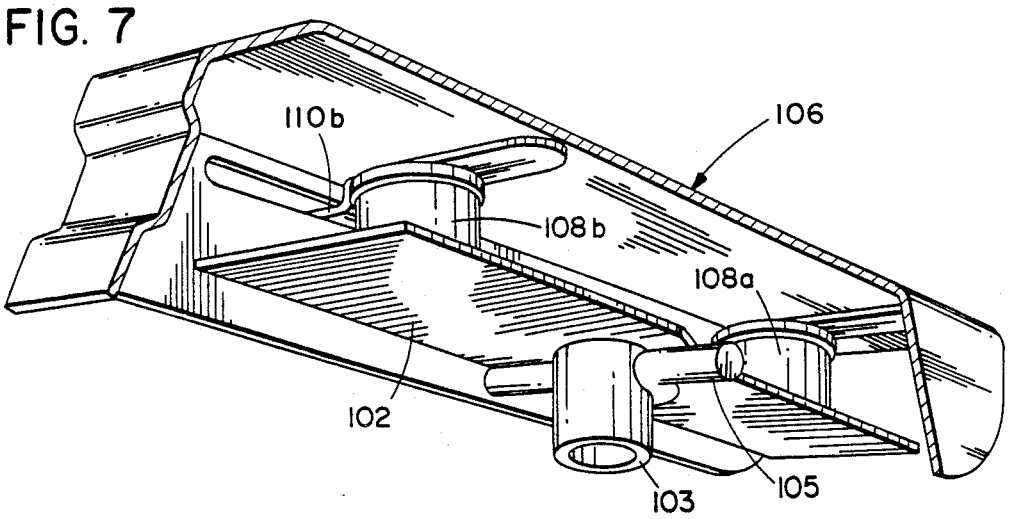
FIG. 7 is a perspective view similar to FIG. 6, as seen from underneath.

In FIG. 3 there is illustrated an intermediate position of the two elastic means 8*a*, 8*b*, the supporting means 6 with its not illustrated seat being illustrated in a forwardly tilted position, i.e. in the direction of the arrow A. In this case the upper resilient means 8*a* is compressed between the rigid plate 2 and the top portion 6*x* of the housing-shaped supporting means 6, whereas the lower elastic means 8*b* is here insignificantly affected.

Figure 4:
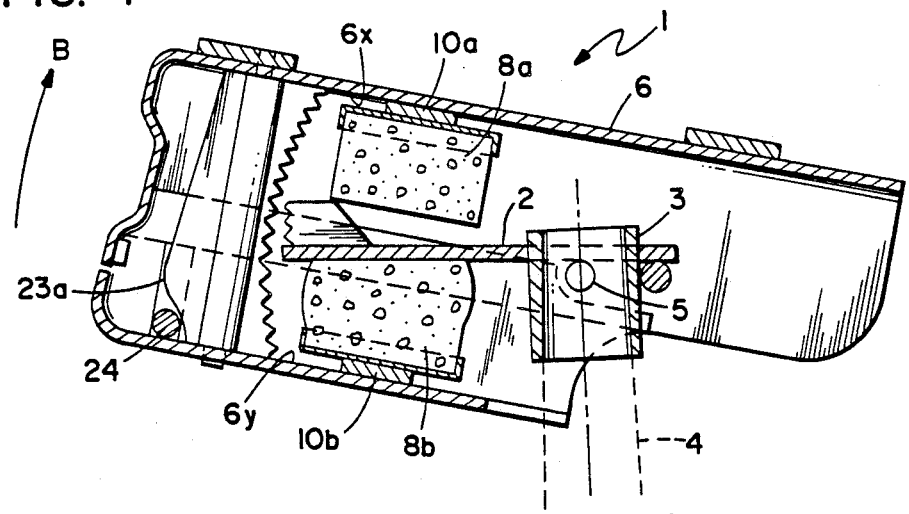
FIG. 4 is a section similar to FIG. 2, and illustrates the tilting mechanism in a rearwardly tilted position.

In FIG. 4 there is illustrated a rearwardly tilted position of the supporting means 6, the lower resilient means here being compressed between the lower portion 6*y* of the housing-shaped supporting means 6 and the rigid plate 2. In this case the upper elastic means 8*a* is not at all influenced.

If both levers are brought to their extreme forward positions, i.e. having their elastic means in the positions most remote from the tilting shaft, there is achieved a small tilt or large tilting stiffness in both directions, i.e. an approximately stable seat.

If both levers are brought to their extreme rear positions there are, on the other hand achieved large and soft tilting movements in both directions.

As mentioned above, the rigid plate 2 and the mounting means 3 mounted on the chair base 4, are to be regarded as stationary in relation to the supporting means 6 including the not illustrated seat. In order to secure a locking of the chair seat in an arbitrary forwardly tilted position, for example as illustrated in FIG. 3, or any random rearwardly tilted position, for example as illustrated in FIG. 4, or in a neutral position, for example as illustrated in FIG. 2, there is in the housing-shaped supporting means 6 provided a locking means which will be discussed in the following.

The locking means comprises a first engagement means 20 arranged at the end of the rigid plate 2 and being at its one edge provided with a plurality of grooves or teeth 20*a*. In the supporting means 6 there is provided a corresponding engagement means 21 having a larger extention in the vertical direction then the above mentioned engagement.means 20, and being provided with a plurality of teeth or grooves 21*a* corresponding to the teeth 20*a* of the first engagement means 20. The second engagement means 21 comprises a bearing portion 22 which can pivot around a vertical shaft 23 against the force of a not illustrated spring, said not illustrated spring seeking to urge a back portion 23*a* of the engagement means 21 against a protruding locking-/release arm 24. This locking/release arm 24 is also illustrated in FIGS. 1–4, the arm 24 in FIG. 2 being illustrated in its raised position in which it is located a distance up the back portion 23*a* and presses the engagement means 21 to engagement with the smaller engagement means 20 on the rigid plate 2. In other words the locking/release arm 24 is illustrated in its locked position in FIG. 2, the teeth 20*a* and 21*a* of the engagement means 20 and 21, respectively, being in mutual engagement with each other and being maintained in this position due to the raised position of the locking/release arm.

Upon lowering of the locking/release arm 24 the engagement means 21 will pivot out of engagement with the engagement means 20, involving the release of the seat including the supporting means 6 for tilting movement around the tilting shaft 5. Depending on the number of teeth and the distribution thereof, there may be achieved a finer or coarser adjustment of the desired fixed seat angle, the adjustment being made finer by an increasing number of teeth or grooves.

In FIGS. 6–10 there is illustrated another example of a tilting mechanism according to the present invention, there here being used the same reference numerals with the addition of 100 for corresponding structural elements, but deleting the above discussed locking means in the embodiment according to FIGS. 6–10. Of course, this locking means can be included, but has here been deleted for the sake of survey.

The differences between the embodiment according to FIGS. 6–10 and the embodiment according to FIGS. 1–5 reside in the resilient means 108*a* and 108*b* being adapted to cooperate with the same side of the rigid plate 102, the first resilient means 108*a* being provided on the forward side of the tilting shaft 105, whereas the second resilient means 108*b* being provided on the rear side of the tilting shaft 105. The first resilient means 108*a* is attached in a lid-shaped holding means 109*a* which in turn is attached to a forward lever 110*a*. The lever 110*a* is in turn pivotably supported in the top portion 106*x* of the supporting means 106, for example by a pivoting pin 111*a*.

Correspondingly, the rear elastic means 108*b* is attached in a cup-shaped holding means 109*b* which is attached to a rear lever 110*b* which is pivotably provided in the top portion 106*x* of the supporting means 106 by a pivoting means 111*b*.

Each of the levers 110*a* og 110*b* protrude out from its own transverse slot 112*a* and 112*b*, respectively, so that the user of the chair by means of the levers can pivot each of the resilient means individually along different portions of the rigid plate 102 for adjusting the tilting stiffness of the seat.

Figure 8:
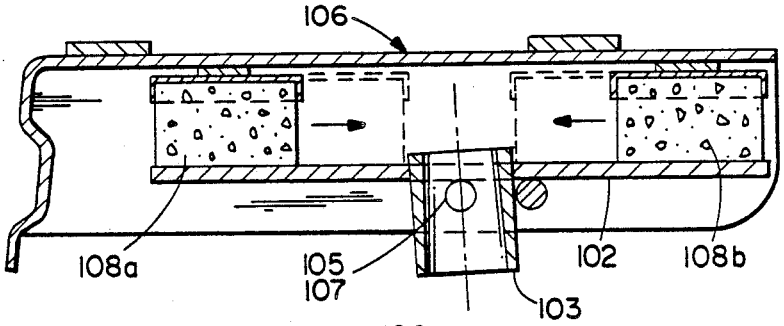
FIG. 8 is a schematic section through the embodiment illustrated in FIGS. 6 and 7, the resilient means being shown displaced in each direction.

As it is appearent from FIG. 8, each of the elastic means 108*a* and 108*b* can thus be displaced individually between a position at a far distance from said pivoting shaft 105, as this is illustrated with solid lines in FIG. 8, or to a position close to the tilting shaft 105 of the seat supporting means 106, as this is illustrated with dashed lines in the same Figure.

Figure 9:
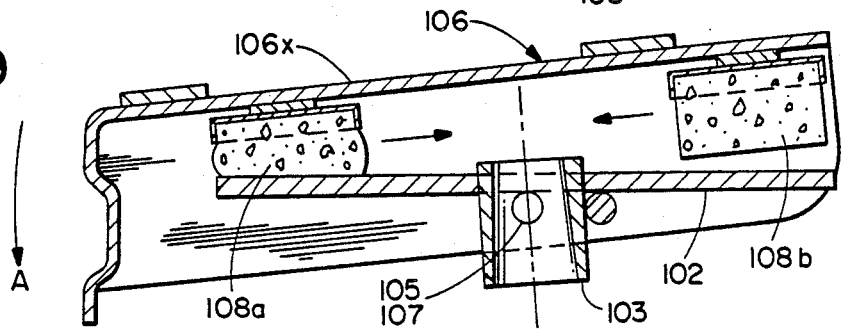
FIG. 9 is a section similar to FIG. 8, and illustrates the tilting mechanism in a forwardly tilted position.

In FIG. 9 the supporting means 106 is illustrated in a forwardly tilted position, i.e. in a direction of the arrow A. In this case the front resilient means 108*a* will be compressed between the rigid plate 102 and the top portion 106*x* of the housing-shaped supporting means 106, whereas the rear elastic means 108*b* is here uninfluenced.

Figure 10:
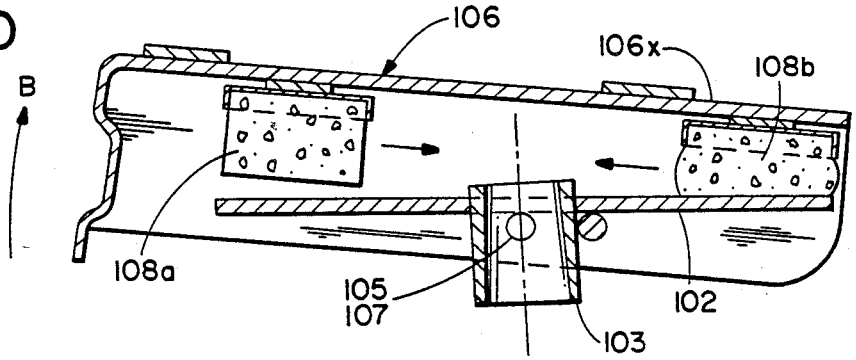
FIG. 10 is a section similar to FIG. 8, and illustrates the tilting mechanism in a rearwardly tilted position.

In FIG. 10 there is illustrated a rearwardly tilted position of the supporting means 106, the rear resilient means 108*b* here being compressed between the upper portion 106*x* of the housing-shaped supporting means 106 and the rigid plate 102. In this case tho front elastic means 108*a* is not at all influenced.

In the positions of the elastic means 108*a* and 108*b* illustrated in FIGS. 9 and 10, i.e. the elastic means being in position most remote from the pivoting or tilting shaft 105, there is achieved a small tilting or large tilting stiffness in both directions, i.e. an approximately stable seat.

If both the elastic means are brought close to the pivoting shaft 105 there will be achieved large and soft tilting movements in both directions.

Figure 11:
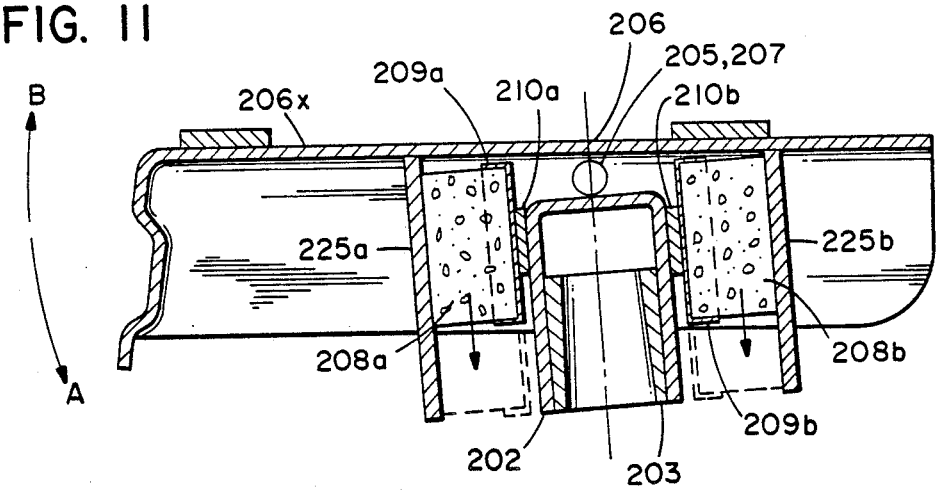
FIG. 11 is a section through a further embodiment of the tilting mechanism according to the invention.
Figure 12:
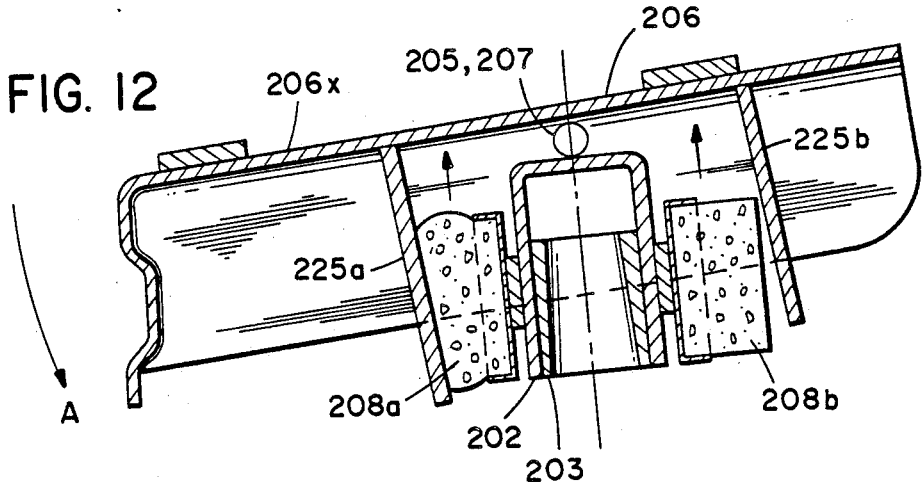
FIG. 12 is a section similar to FIG. 11, and illustrates the tilting mechanism in forwardly tilted position.
Figure 13:
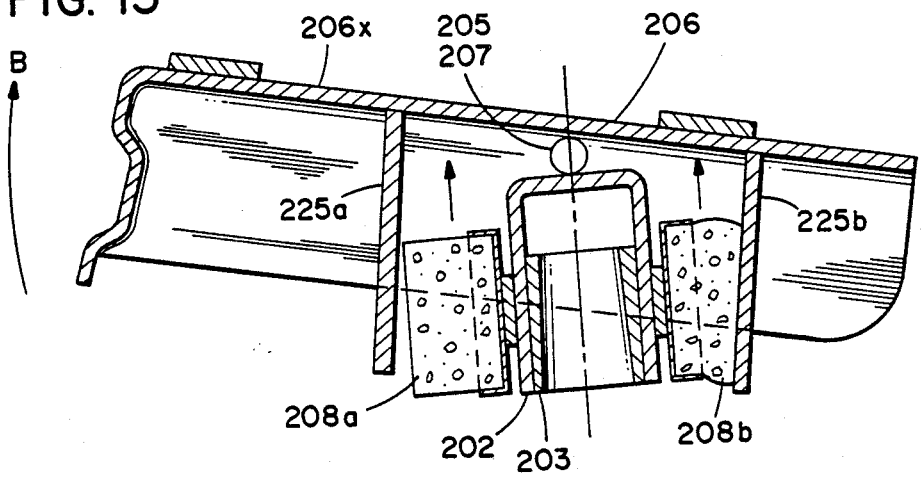
FIG. 13 is a section similar to FIG. 11, and illustrates the tilting mechanism in a rearwardly tilted position.

In the embodiment illustrated in FIGS. 11, 12 and 13 the rigid element does not take the form of a plate, but takes the form of a sleeve 202 which is mounted on the mounting means 203. Further, this embodiment is provided with rigid portions 225*a* and 225*b* protruding downwardly from the top portion 206*x* of the housing-shaped supporting means 206.

In FIGS. 11, 12 and 13 there is also illustrated a front resilient means 208*a* and a rear resilient means 208*b*, said means being attached in their own cup-shaped holding means 209*a* and 209*b*, respectively, which in turn are attached to displacement means 210*a* and 210*b* for substantially vertical displacement of the individual elastic means 208*a* and 208*b*. Thus, by the displacement means 210*a* and 210*b* each of the elastic means 208*a* and 208*b* can be displaced individually between an upper position, as this is illustrated with solid lines in FIG. 11, and a lower position which in FIG. 11 is illustrated by dashed lines, wherein said means are at a far distance from the pivoting shaft 205.

In FIG. 12 the supporting means 206 is illustrated in a forwardly tilted position, i.e. in the direction of the arrow A, wherein the front resilient means 208*a* is compressed between the downwardly protruding portion 225*a* and the rigid, sleeve-shaped element 202, whereas the rear elastic means 208*b* is here uninfluenced.

In FIG. 13 there is illustrated a rearwardly tilted position of the supporting means 206, here in direction of the arrow B, the rear resilient means here being compressed between the second downwardly protruding portion 225*b* and the rigid, sleeve-shaped means 202. In this case the front elastic means 208*a* is not at all influenced.

Because the elastic means 208*a* and 208*b* can be regulated individually, it is possible to vary the tilting stiffness of the seat movement depending on whether the individual elastic means are close to or far from the pivoting shaft 205.

It is to be understood that the above discussed embodiments only represent preferred embodiments, the invention allowing for a plurality of other implementations.

For example, the elastic or resilient means can be provided not only as rubber blocks, but also as springs or other elastic pliable means.

Further, it is to be understood that the displacement of the elastic means can be realized in other manners than by means of levers as illustrated. For example, there may be provided a mechanism which displaces the elastic means by a wheel or a turnable nob. Possibly, there may be provided an operating mechanism on each side of the supporting means, and as an alternative there may be provided more than one resilient means for adjusting the tilting stiffness of the forward tilting and the rearward tilting, respectively.

In connection with the tilting mechanism accordning to the present invention there is achieved a separate or individual tightening of the forward tilting and the rearward tilting of the seat without changing the seat angle during the adjustment of the tighening, which is the case in previously known tilting devices. Besides, in the present tilting device there is avoided that the adjustment takes place by means of a screwing device, the present invention appropriately allowing for the use of displacement levers for adjusting the individual tilting stiffness. By displacing the rubber blocks illustrated on the Figures towards or from the tilting shaft, it is possible due to a longer or shorter moment arm to regulate the tilting stiffness, since a longer arm or shorter distance from the tilting shaft entails a stiffer tilting, whereas a shorter arm or shorter distance from the tilting shaft entails a softer tilting.

I claim:

1. Tilting mechanism (1), preferably for a chair seat or similar article, comprising a rigid element (2) which via a mounting means (3) can be attached to a chair base (4), a supporting means (6) adapted to the chair seat and pivotably connected in relation to said mounting means (3), resilient means (8*a*, 8*b*) which is so arranged between said supporting means (6) and said rigid plate (2) that such supporting means (6) can be tilted in relation to said rigid plate (2) under the influence of said resilient means (8*a*, 8*b*), as well as locking means (20, 21, 24) for adjusting said seat supporting means (6) to various tilting position, characterized in that at least one of said resilient means (8*a*, 8*b*) is arranged displaceable in relation to the tilting shaft (5) of the supporting means (6), for thereby adjusting the power influencing the resilient means (8*a*, 8*b*) and thereby the tilting stiffness to which the supporting means (6) is subjected during tilting.

2. Mechanism as stated in claim 1, characterized in that the mechanism comprises at least two resilient means (8*a*, 8*b*; 108*a*, 108*b*; 208*a*, 208*b*) which can be displaced individually in relation to said tilting shaft (5; 105; 205).

3. Mechanism as stated in claim 1 or 2, characterized in that the resilient means (8*a*, 8*b*; 108*a*, 108*b*) are connected to displacement means (10*a*, 10*b*; 110*a*, 110*b*) allowing for individual substantially horizontal displacement of the resilient means.

4. Mechanism as stated in claim 1, characterized in that the resilient means (208*a*, 208*b*) are connected to displacement means (210*a*, 210*b*) for individual substantially vertical displacement of said resilient means.

5. Mechanism as stated in claim 1, characterized in that the resilient means (8*a*, 8*b*) are provided in a house like supporting means (6), and that the individual resilient means (8*a*, 8*b*, respectively) is attached in its own pivotable lever (10*a*, 10*b*, respectively), each of which is attached to a first portion (6*x*) and a second portion (6*y*), respectively, of the supporting means (6).

6. Mechanism as stated in claim 1, characterized in that each of the levers (10*a*, 10*b*) have an end portion protruding freely out through a slot (12*a*, 12*b*, respectively) in the side wall of the housing-shaped supporting means (6), each of said resilient means (8*a*, 8*b*) uppon pivoting of the levers (10*a*, 10*b*) being swept along their own surface portion of the rigid element (2).

7. Mechanism as stated in claim 1, characterized in that each of the resilient means (8*a*, 8*b*) can be displaced from a first position close to the tilting shaft (5) of the seat supporting means (6), and to a second position at a far distance from said tilting shaft (5), such that the user, when both resilient means (8*a*, 8*b*) are in their first position, will be offered a small tilting stiffness in both directions (forwardly and rearwardly), such that the user, when both means (8*a*, 8*b*) are in their second position, will be offered large tilting stiffness, and such that the user, when said displaceable means (8*a*, 8*b*) are in various intermediate positions will be offered optional tilting stiffnesses in the forward direction (A) and the rearward direction (B), respectively.

8. Mechanism as stated in claim 1, characterized in that each of the resilient means (8*a*, 8*b*) take the form of a cylindrical, elastic rubber block which at its one end is attached in a lid-shaped holding means (9*a*, 9*b*, respectively) which in turn is attached to its own lever (10*a*, 10*b*, respectively), and at their other end faces their respective portion of the rigid element (2).

9. Mechanism as stated in claim 1, characterized by a resilient means (8*a*) cooperating with the upper side of the rigid element in the form of a rigid plate (2), and by a resilient means (8*b*) cooperating with the lower side of the rigid plate (2), each of said resilient means (8*a*, 8*b*) being displaceable independent of each other in relation to the tilting shaft (5) of the supporting means (6).

10. Mechanism as stated in claim 1, characterized in that a first resilient means (108*a*) is provided on the one side of the tilting shaft (105), whereas a second resilient means (108*b*) is provided on the other side of said tilting shaft (105), said both means being displaceable on the same side of said rigid element (102).

11. Mechanism as stated in claim 1, characterized in that the rigid element takes the form of a sleeve (202).

12. Mechanism as stated in claim 11, characterized in that the sleeve (208) comprises individually displaceable means (210*a*, 210*b*) carrying their own resilient means (208*a*, 208*b*), and allowing substantially vertical displacement of the individual means, and that the individual resilient means co-operate with rigid portions (225*a*, 225*b*) protruding from said supporting means (206).

13. Mechanism as stated in claim 1, characterized in that at the end of the rigid plate (2) there is provided a first engagement means (20), and that in the supporting means (6) there is provided a corresponding engagement means (21) which can be brought into and out of engagement with said first engagement means (20) for locking the house shaped supporting means (6) in various tilting positions.

14. Mechanism as stated in claim 13, characterized in that the corresponding engagement means (21) in the housing-shaped supporting means (6) is arranged pivotable (23) against the influence of a pre-stressing means, said engagement means (21) by means of a locking-/release arm (24) being displaceable from a first released position (FIG. 3) to a second locking position (FIG. 2) in said first engagement means (20).

15. Mechanism as stated in claim 13, characterized in that the first engagement means (20) eomprises a small element having a few grooves (20*a*), whereas the corresponding engagement means (21) comprises a plurality of grooves (21*a*) arranged in a gentle arc, such that a locking tilting position of the supporting means (6) can be achieved so to say continuously within the seat tilting range.

16. Mechanism as stated in claim 2, characterized in that the resilient means (8*a*, 8*b*; 108*a*, 108*b*) are connected to displacement means (10*a*, 10*b*; 110*a*, 110*b*) allowing for individual substantially horizontal displacement of the resilient means.

17. Mechanism as stated in claim 2, characterized in that the resilient means (208*a*, 208*b*) are connected to displacement means (210*a*, 210*b*) for individual substantially vertical displacement of said resilient means.

18. Mechanism as stated in claim 2, characterized in that the resilient means (8*a*, 8*b*) are provided in a house-like supporting means (6), and that the individual resilient means (8*a*, 8*b*, respectively) is attached in its own pivotable lever (10*a*, 10*b*, respectively), each of which is attached to a first portion (6*x*) and a second portion (6*y*), respectively, of the supporting means (6).

19. Mechanism as stated in claim 3, characterized in that the resilient means (8*a*, 8*b*) are provided in a house-like supporting means (6), and that the individual resilient means (8*a*, 8*b*, respectively) is attached in its own pivotable lever (10*a*, 10*b*, respectively), each of which is attached to a first portion (6*x*) and a second portion (6*y*), respectively, of the supporting means (6).

20. Mechanism as stated in claim 2, characterized in that each of the levers (10*a*, 10*b*) have an end portion protruding freely out through a slot (12*a*, 12*b*, respectively) in the side wall of the housing-shaped supporting means (6), each of said resilient means (8*a*, 8*b*) upon pivoting of the levers (10*a*, 10*b*) being swept along their own surface portion of the rigid element (2).

21. Mechanism as stated in claim 2, characterized in that each of the levers (10*a*, 10*b*) have an end portion protruding freely out through a slot (12*a*, 12*b*, respectively) in the side wall of the housing-shaped supporting means (6), each of said resilient means (8*a*, 8*b*) upon pivoting of the levers (10*a*, 10*b*) being swept along their own surface portion of the rigid element (2).

22. Mechanism as stated in claim 4, characterized in that each of the levers (10*a*, 10*b*) have an end portion protruding freely out through a slot (12*a*, 12*b*, respectively) in the side wall of the housing-shaped supporting means (6), each of said resilient means (8*a*, 8*b*) upon pivoting of the levers (10*a*, 10*b*) being swept along their own surface portion of the rigid element (2).

23. Mechanism as stated in claim 5, characterized in that each of the levers (10*a*, 10*b*) have an end portion protruding freely out through a slot (12*a*, 12*b*, respectively) in the side wall of the housing-shaped supporting means (6), each of said resilient means (8*a*, 8*b*) upon pivoting of the levers (10*a*, 10*b*) being swept along their own surface portion of the rigid element (2).

24. Mechanism as stated in claim 2, characterized in that each of the resilient means (8*a*, 8*b*) can be displaced from a first position close to the tilting shaft (5) of the seat supporting means (6), and to a second position at a far distance from said tilting shaft (5), such that the user, when both resilient means (8*a*, 8*b*) are in their first position, will be offered a small tilting stiffness in both directions (forwardly and rearwardly), such that the user, when said displaceable means (8*a*, 8*b*) are in various intermediate positions will be offered optional tilting stiffnesses in the forward direction (A) and the rearward direction (B), respectively.

25. Mechanism as stated in claim 3, characterized in that each of the resilient means (8*a*, 8*b*) can be displaced from a first position close to the tilting shaft (5) of the seat supporting means (6), and to a second position at a far distance from said tilting shaft (5), such that the user, when both resilient means (8*a*, 8*b*) are in their first position, will be offered a small tilting stiffness in both directions (forwardly and rearwardly), such that the user, when said displaceable means (8*a*, 8*b*) are in various intermediate positions will be offered optional tilting stiffnesses in the forward direction (A) and the rearward direction (B), respectively.

26. Mechanism as stated in claim 4, characterized in that each of the resilient means (8*a*, 8*b*) can be displaced from a first position close to the tilting shaft (5) of the seat supporting means (6), and to a second position at a far distance from said tilting shaft (5), such that the user, when both resilient means (8*a*, 8*b*) are in their first position, will be offered a small tilting stiffness in both directions (forwardly and rearwardly), such that the user, when said displaceable means (8*a*, 8*b*) are in various intermediate positions will be offered optional tilting stiffnesses in the forward direction (A) and the rearward direction (B), respectively.

27. Mechanism as stated in claim 2, characterized in that each of the resilient means (8*a*, 8*b*) take the form of a cylindrical, elastic rubber block which at its one end is attached in a lid-shaped holding means (9*a*, 9*b*, respectively) which in turn is attached to its own lever (10*a*, 10*b*, respectively), and at their other end faces their respectively portion of the rigid element (2).

28. Mechanism as stated in claim 3, characterized in that each of the resilient means (8*a*, 8*b*) take the form of a cylindrical, elastic rubber block which at its one end is attached in a lid-shaped holding means (9*a*, 9*b*, respectively) which in turn is attached to its own lever (10*a*, 10*b*, respectively), and at their other end faces their respective portion of the rigid element (2).

29. Mechanism as stated in claim 4, characterized in that each of the resilient means (8*a*, 8*b*) take the form of a cylindrical, elastic rubber block which at its one end is attached in a lid-shaped holding means (9*a*, 9*b*, respectively) which in turn is attached to its own lever (10*a*, 10*b*, respectively), and at their other end faces their respective portion of the rigid element (2).

30. Mechanism as stated in claim 3, characterized in that a first resilient means (108*a*) is provided on the one side of the tilting shaft (105), whereas a second resilient means (108*b*) is provided on the other side of said tilting shaft (105), said both means being displaceable on the same side of said rigid element (102).

31. Mechanism as stated in claim 4, characterized in that a first resilient means (108*a*) is provided on the one side of the tilting shaft (105), whereas a second resilient means (108*b*) is provided on the other side of said tilting shaft (105), said both means being displaceable on the same side of said rigid element (102).

32. Mechanism as stated in claim 5, characterized in that a first resilient means (108*a*) is provided on the one side of the tilting shaft (105), whereas a second resilient means (108*b*) is provided on the other side of said tilting shaft (105), said both means being displaceable on the same side of said rigid element (102).

33. Mechanism as stated in claim 10, characterized in that at the end of the rigid place (2) there is provided a first engagement means (20), and that in the supporting means (6) there is provided a corresponding engagement means (21) which can be brought into and out of engagement with said first engagement means (20) for locking the housing-shaped supporting means (6) in various tilting positions.

34. Mechanism as stated in claim 11, characterized in that at the end of the rigid plate (2) there is provided a first engagement means (20), and that in the supporting means (6) there is provided a corresponding engagement means (21) which can be brought into and out of engagement with said first engagement means (20) for locking the housing-shaped supporting means (6) in various tilting positions.

35. Mechanism as stated in claim 12, characterized in that at the end of the rigid plate (2) there is provided a first engagement means (20), and that in the supporting means (6) there is provided a corresponding engagement means (21) which can be brought into and out of engagement with said first engagement means (20) for locking the housing-shaped supporting means (6) in various tilting positions.

36. Mechanism as stated in claim 14, characterized in that the first engagement means (20) comprises a small element having a few grooves (20*a*), whereas the corresponding engagement means (21) comprises a plurality of grooves (21*a*) arranged in a gentle arc, such that a locking tilting position of the supporting means (6) can be achieved so to say continuously within the seat tilting range.

* * * * *